US010867568B2

(12) United States Patent
Kim et al.

(10) Patent No.: US 10,867,568 B2
(45) Date of Patent: Dec. 15, 2020

(54) LIQUID CRYSTAL DISPLAY DEVICE AND DRIVING METHOD THEREOF COMPRISING LOW REFRESH RATE POLARITY INVERSION PATTERNS

(71) Applicant: LG Display Co., Ltd., Seoul (KR)

(72) Inventors: Jongwoo Kim, Paju-si (KR); Jeongju Yang, Daegu (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/531,970

(22) Filed: Aug. 5, 2019

(65) Prior Publication Data

US 2020/0051516 A1 Feb. 13, 2020

(30) Foreign Application Priority Data

Aug. 7, 2018 (KR) ..... 10-2018-0091978

(51) Int. Cl.
*G09G 3/36* (2006.01)

(52) U.S. Cl.
CPC ..... *G09G 3/3614* (2013.01); *G09G 3/3618* (2013.01); *G09G 3/3677* (2013.01); *G09G 3/3688* (2013.01); *G09G 2310/08* (2013.01); *G09G 2360/12* (2013.01); *G09G 2360/18* (2013.01)

(58) Field of Classification Search
CPC .. G09G 3/3614; G09G 3/3688; G09G 3/3618; G09G 3/3677; G09G 3/20; G09G 3/36; G09G 2310/08; G09G 2360/12; G09G 2360/18
See application file for complete search history.

(56) References Cited

U.S. PATENT DOCUMENTS

2014/0333516 A1* 11/2014 Park ..... G09G 3/3614 345/89
2015/0002381 A1* 1/2015 Fujioka ..... G09G 3/3614 345/87
2015/0187334 A1* 7/2015 Oh ..... G09G 3/2025 345/204

(Continued)

FOREIGN PATENT DOCUMENTS

KR 10-2015-0078833 A 7/2015
KR 10-2016-0029993 A 3/2016

*Primary Examiner* — Darlene M Ritchie
(74) *Attorney, Agent, or Firm* — Polsinelli PC

(57) ABSTRACT

A liquid crystal display device comprises a memory configured to store polarities of the source outputs from a source driver with respect to a panel self-refresh operation and a normal refresh operation that is not the panel self-refresh operation as a first inversion pattern and to store the polarities of source outputs with respect to a low refresh rate operation as a second inversion pattern; and an LRR controller configured to control the polarities of the source outputs with the first inversion pattern in panel self-refresh frames before the low refresh rate operation is performed, to control the polarities of the source outputs with a third inversion pattern referring to the first inversion pattern in low refresh rate frames in which the low refresh rate operation is performed, and to control the polarities of the source outputs with a fourth inversion pattern referring to the second inversion pattern in normal refresh frames after the low refresh rate operation ends.

20 Claims, 13 Drawing Sheets

(56) References Cited

U.S. PATENT DOCUMENTS

| | | | | |
|---|---|---|---|---|
| 2015/0243234 | A1* | 8/2015 | Bloks | G09G 3/3618<br>345/96 |
| 2015/0243235 | A1* | 8/2015 | Inada | G09G 3/3659<br>345/209 |
| 2016/0012789 | A1* | 1/2016 | Miyazawa | G09G 3/3648<br>345/209 |
| 2016/0155399 | A1* | 6/2016 | Tripathi | G06T 1/20<br>345/506 |
| 2016/0203780 | A1* | 7/2016 | Kita | G09G 3/3614<br>345/691 |

* cited by examiner

FIG. 2

| | F#1 | F#2 | F#3 | F#4 | F#5 | F#6 | F#7 | F#8 | F#9 | F#10 | F#11 | F#12 |
|---|---|---|---|---|---|---|---|---|---|---|---|---|
| Input Data | N+1 | N+2 | N+3 | N+3 | N+3 | N+3 | N+3 | N+3 | N+4 | N+5 | N+6 | N+7 |
| PSR | PSR off | | | PSR on | | | | | PSR off | | | |
| eDP Tx | N+1 | N+2 | N+3 | Off | Off | Off | Off | Off | N+4 | N+5 | N+6 | N+7 |
| Display Data | N+1 | N+2 | N+3 | N+3 | N+3 | N+3 | N+3 | N+3 | N+4 | N+5 | N+6 | N+7 |
| Gate/ Source | All Lines | All Lines | All Lines | All Lines | All Lines | All Lines | All Lines | All Lines | All Lines | All Lines | All Lines | All Lines |
| POL | (+) | (−) | (+) | (−) | (+) | (−) | (+) | (−) | (+) | (−) | (+) | (−) |
| ABDEN | | | | | | | | | | | | |

FIG. 7

First inversion pattern

| | Frame No. | F#1 | F#2 | F#3 | F#4 | F#5 | F#6 | F#7 | F#8 | F#9 | F#10 | F#11 | F#12 | F#13 | F#14 | F#15 | F#16 | F#17 | F#18 | F#19 | F#20 |
|---|---|---|---|---|---|---|---|---|---|---|---|---|---|---|---|---|---|---|---|---|---|
| Normal & PSR | Display | D | D | D | D | D | D | D | D | D | D | D | D | D | D | D | D | D | D | D | D |
| | POL | P | P' | P | P' | P | P' | P | P' | P | P' | P | P' | P | P' | P | P' | P | P' | P | P' |
| | | (+) | (−) | (+) | (−) | (+) | (−) | (+) | (−) | (+) | (−) | (+) | (−) | (+) | (−) | (+) | (−) | (+) | (−) | (+) | (−) |
| LRR | Display | D | S | D | S | D | S | D | S | D | S | D | S | D | S | D | S | D | S | D | S |
| | POL | P | H | P' | H | P | H | P' | H | P | H | P' | H | P | H | P' | H | P | H | P' | H |
| | | (+) | (+) | (−) | (−) | (+) | (+) | (−) | (−) | (+) | (+) | (−) | (−) | (+) | (+) | (−) | (−) | (+) | (+) | (−) | (−) |

Second inversion pattern

FIG. 8

PSR ← → LRR entry time → LRR

| | Frame No. | F#1 | F#2 | F#3 | F#4 | F#5 | F#6 | F#7 | F#8 | F#9 | F#10 | F#11 | F#12 | F#13 | F#14 | F#15 | F#16 | F#17 | F#18 | F#19 | F#20 |
|---|---|---|---|---|---|---|---|---|---|---|---|---|---|---|---|---|---|---|---|---|---|
| Case 1) | Display | D | D | D | D | D | D | D | D | D | D | D | D | D | S | D | S | D | S | D | S |
| | POL | P | P' | P | P' | P | P' | P | P' | P | P' | P | P' | P | H | P' | H | P | H | P' | H |
| | | (+) | (−) | (+) | (−) | (+) | (−) | (+) | (−) | (+) | (−) | (+) | (−) | (+) | (+) | (−) | (−) | (+) | (+) | (−) | (−) |
| Case 2) | Display | D | D | D | D | D | D | D | D | D | D | D | D | D | S | D | S | D | S | D | S |
| | POL | P | P' | P | P' | P | P' | P | P' | P | P' | P | P' | P | H | P' | H | P | H | P' | H |
| | | (+) | (−) | (+) | (−) | (+) | (−) | (+) | (−) | (+) | (−) | (+) | (−) | (+) | (+) | (−) | (−) | (+) | (+) | (−) | (−) |
| Case 3) | Display | D | D | D | D | D | D | D | D | D | D | D | S | D | S | D | S | D | S | D | S |
| | POL | P | P' | P | P' | P | P' | P | P' | P | P' | P | H | P | H | P' | H | P | H | P' | H |
| | | (+) | (−) | (+) | (−) | (+) | (−) | (+) | (−) | (+) | (−) | (+) | (−) | (+) | (+) | (−) | (−) | (+) | (+) | (−) | (−) |
| Case 4) | Display | D | D | D | D | D | D | D | D | D | D | D | S | D | S | D | S | D | S | D | S |
| | POL | P | P' | P | P' | P | P' | P | P' | P | P' | P' | H | P | H | P' | H | P | H | P' | H |
| | | (+) | (−) | (+) | (−) | (+) | (−) | (+) | (−) | (+) | (−) | (−) | (−) | (+) | (+) | (−) | (−) | (+) | (+) | (−) | (−) |

FIG. 9

LRR | LRR exit time | Normal

| | Frame No. | F#1 | F#2 | F#3 | F#4 | F#5 | F#6 | F#7 | F#8 | F#9 | F#10 | F#11 | F#12 | F#13 | F#14 | F#15 | F#16 | F#17 | F#18 | F#19 | F#20 |
|---|---|---|---|---|---|---|---|---|---|---|---|---|---|---|---|---|---|---|---|---|---|
| Case 1) | Display | D | S | D | S | D | S | D | D | D | D | D | D | D | D | D | D | D | D | D | D |
| | POL | P | H | P' | H | P | H | P | P' | P | P' | P | P' | P | P' | P | P' | P | P' | P | P' |
| | | (+) | (+) | (-) | (-) | (+) | (+) | (+) | (-) | (+) | (-) | (+) | (-) | (+) | (-) | (+) | (-) | (+) | (-) | (+) | (-) |
| Case 2) | Display | D | S | D | S | D | S | D | D | D | D | D | D | D | D | D | D | D | D | D | D |
| | POL | P | H | P' | H | P | H | P' | P' | P | P' | P | P' | P | P' | P | P' | P | P' | P | P' |
| | | (+) | (+) | (-) | (-) | (+) | (+) | (-) | (-) | (+) | (-) | (+) | (-) | (+) | (-) | (+) | (-) | (+) | (-) | (+) | (-) |
| Case 3) | Display | D | S | D | S | D | S | D | S | D | D | D | D | D | D | D | D | D | D | D | D |
| | POL | P | H | P' | H | P | H | P' | H | P | P' | P | P' | P | P' | P | P' | P | P' | P | P' |
| | | (+) | (+) | (-) | (-) | (+) | (+) | (-) | (-) | (+) | (-) | (+) | (-) | (+) | (-) | (+) | (-) | (+) | (-) | (+) | (-) |
| Case 4) | Display | D | S | D | S | D | S | D | S | D | D | D | D | D | D | D | D | D | D | D | D |
| | POL | P | H | P' | H | P | H | P' | H | P | P' | P | P' | P | P' | P | P' | P | P' | P | P' |
| | | (+) | (+) | (-) | (-) | (+) | (+) | (-) | (-) | (+) | (-) | (+) | (-) | (+) | (-) | (+) | (-) | (+) | (-) | (+) | (-) |

LIQUID CRYSTAL DISPLAY DEVICE AND DRIVING METHOD THEREOF COMPRISING LOW REFRESH RATE POLARITY INVERSION PATTERNS

CROSS REFERENCE TO RELATED APPLICATION

This application claims the benefit of Korea Patent Application No. 10-2018-0091978 filed on Aug. 7, 2018, which is hereby incorporated by reference in its entirety.

BACKGROUND

Field of the Disclosure

The present document relates to a display device, and more particularly, to an active matrix type liquid crystal display device and a driving method thereof.

Description of the Background

Display devices can be implemented in the forms of a liquid crystal display device, a field emission display device, an electrophoretic display device, an electro-wetting display device, an organic light-emitting diode display device, a quantum-dot display device and the like. Among these, liquid crystal display devices of large-area and high-resolution models are widely used.

Liquid crystal display devices use a technique of reversing the polarity of a source output, so-called "polarity inversion technique", in order to prevent display quality from deteriorating due to common voltage shift when an image is output. Liquid crystal display devices also use panel self-refresh (hereinafter referred to as "PSR") and a low refresh rate (hereinafter referred to as "LRR") in order to achieve low power consumption. The PSR is a technique of stopping output of a host system when a still image continues and repeatedly outputting the same image using a frame buffer mounted in a display module. The LRR is a technique of stopping output of a panel driver at specific intervals when a still image continues and intermittently skips image output, such as line skip or frame skip, to reduce power consumption.

However, when the LRR is applied regardless of the source output polarities, the same source output polarity may be accumulated for three or more frames at an LRR entry time and an LRR exit time and can deteriorate display quality.

SUMMARY

Accordingly, the present disclosure provides a liquid crystal display device and a driving method thereof capable of minimizing a period in which the same polarity is accumulated by changing source output polarities in accordance with LRR techniques.

A liquid crystal display device according to an aspect of the present disclosure includes: a display panel; a source driver for providing source outputs to the display panel; a memory for storing polarities of source outputs with respect to a panel self-refresh operation and a normal refresh operation that is not the panel self-refresh operation as a first inversion pattern and storing polarities of source outputs with respect to a low refresh rate (LRR) operation as a second inversion pattern; and an LRR controller for controlling the polarities of the source outputs with the first inversion pattern in panel self-refresh frames before the LRR operation is performed, controlling the polarities of the source outputs with a third inversion pattern referring to the first inversion pattern in LRR frames in which the LRR operation is performed, and controlling the polarities of the source outputs with a fourth inversion pattern referring to the second inversion pattern in normal refresh frames after the LRR operation ends.

BRIEF DESCRIPTION OF THE DRAWINGS

The accompanying drawings, which are included to provide a further understanding of the disclosure and are incorporated in and constitute a part of this application, illustrate aspects of the disclosure and together with the description serve to explain the principles of the disclosure.

In the drawings:

FIG. 2 is a diagram showing a general PSR technique into which an LRR technique has not been incorporated;

FIG. 7 is a diagram showing first and second inversion patterns for source output polarities which are predetermined with respect to a PSR operation & a normal refresh operation, and an LRR operation respectively;

FIG. 8 is a diagram showing various examples of an LRR entry time and source output polarity changes corresponding thereto as a comparative example of the present disclosure;

FIG. 9 is a diagram showing various examples of an LRR exit time and source output polarity changes corresponding thereto as a comparative example of the present disclosure;

DETAILED DESCRIPTION

The advantages, features and methods for accomplishing the same of the present disclosure will become more apparent through the following detailed description with respect to the accompanying drawings. However, the present disclosure is not limited by aspects described blow and is implemented in various different forms, and the aspects are provided so that this disclosure will be thorough and complete, and will fully convey the scope of the disclosure to those skilled in the art. The present disclosure is defined by the scope of the claims.

Shapes, sizes, ratios, angles, numbers, etc. shown in the figures to describe aspects of the present disclosure are exemplary and thus are not limited to particulars shown in the figures. Like numbers refer to like elements throughout the specification. It will be further understood that when the terms "include", "have" and "comprise" are used in this specification, other parts may be added unless "~ only" is used. An element described in the singular form is intended to include a plurality of elements unless context clearly indicates otherwise.

In interpretation of a component, the component is interpreted as including an error range unless otherwise explicitly described.

It will be understood that, when an element is referred to as being "on" or "under" another element, it can be "directly" on or under another element or can be "indirectly" formed such that an intervening element is also present.

In the following description of the aspects, "first" and "second" are used to describe various components, but such components are not limited by these terms. The terms are used to discriminate one component from another component. Accordingly, a first component mentioned in the following description may be a second component within the technical spirit of the present disclosure.

In the following description, if a detailed description of known techniques associated with the present disclosure would unnecessarily obscure the gist of the present disclosure, detailed description thereof will be omitted.

Hereinafter, aspects of the present disclosure will be described in detail with reference to the attached drawings.

Figure 1:
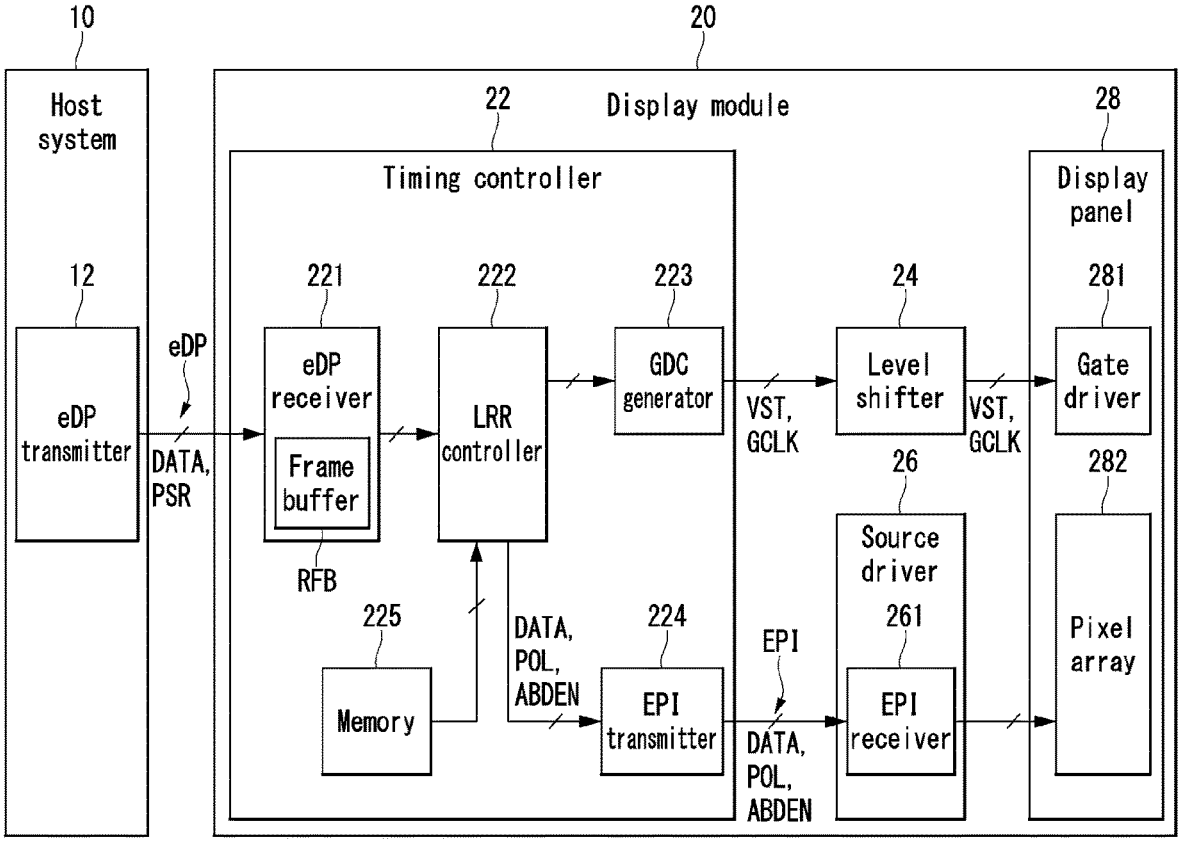
FIG. 1 is a diagram showing a liquid crystal display device according to an aspect of the present disclosure.

FIG. 1 is a diagram showing a liquid crystal display device according to an aspect of the present disclosure.

Referring to FIG. 1, a liquid crystal display device according to an aspect of the present disclosure may include a host system 10 and a display module 20.

The host system 10 may be implemented as various systems such as a television system, a set-top box, a navigation system, a DVD player, a Blu-ray player, a personal computer, a home theater system and a phone system. The host system 10 includes a system on chip (SoC) having a scaler and converts data DATA of an input image into a format suitable for the panel resolution of the display module 20. The host system 10 may transmit a PSR control signal and various timing signals along with the data DATA of the input image to the display module 20.

The host system 10 may be connected to the display module through various interface circuits. For example, the host system 10 may be connected to the display module 20 through an embedded display port (hereinafter referred to as "eDP"). The eDP standard is an interface standard corresponding to a DP interface designed for devices having a display device embedded therein, such as notebook PCs, tablets, netbooks and all-in-one desktop PCs. The eDP may include the PSR technique. The PSR is a technique of minimizing power consumption using a frame buffer (RFB) mounted in the display module 20.

The host system 10 includes an eDP transmitter 12. The eDP transmitter 12 can transmit the input image data DATA, a PSR on/off signal and external timing control signals to the display module 20 through an eDP interface. The eDP transmitter 12 can activate a PSR operation when the input image data DATA is a still image and deactivate the PSR operation when the input image data DATA is a moving image. The eDP transmitter 12 can transmit a PSR on signal for activating the PSR operation to the display module 20 when the input image data DATA is a still image and transmit a PSR off signal for deactivating the PSR operation to the display module 20 when the input image data DATA is a moving image. After the PSR on signal is transmitted to the display module 20, transmission of data (including input image data and external timing control signals) between the eDP transmitter 12 and the display module 20 is stopped (that is, floated) and thus power consumption according to data transmission can be minimized.

The display module 20 may include a timing controller 22, a level shifter 24, a source driver 26 and a display panel 28.

The display panel 28 includes two substrates and liquid crystal cells formed therebetween. A plurality of data lines and a plurality of gate lines are formed on the lower substrate in an intersecting manner. A thin film transistor (TFT), a pixel electrode for charging a data voltage in a liquid crystal cell, and a storage capacitor connected to the pixel electrode to maintain a voltage of the liquid crystal cell are formed at each of intersections of the data lines and the gate lines on the lower substrate of the display panel 28. In addition, a color filter array is formed on the upper substrate of the display panel 28. The color filter array includes a black matrix, color filters and the like.

An upper polarization film may be attached to the upper substrate of the display panel 28, a lower polarization film may be attached to the lower substrate of the display panel 28, and an alignment film for setting a pre-tilt angle of liquid crystal may be formed on the inner surfaces of the substrates which come into contact with a liquid crystal layer. Column spacers for maintaining a cell gap of liquid crystal cells may be further formed between the upper and lower substrates.

A common electrode provided with a common voltage is formed on the lower substrate. The common electrode is electrically connected to a common voltage supply line formed on the lower substrate to be provided with the common voltage from the common voltage supply line. An electric field is formed between the common electrode and a pixel electrode and transmissivity of a liquid crystal cell is determined by the electric field. A liquid crystal cell can be driven in a normally black mode in which transmissivity or gradation increases as a potential difference between a data voltage applied to a pixel electrode and the common voltage applied to the common electrode increases or in a normally white mode in which transmissivity or gradation decreases as the potential difference between the data voltage and the common voltage increases.

The display panel 28 may be implemented as any type of a transmission type display device, a transflective display device and a reflection type display device. The transmission type display device and the transflective display device require a backlight unit. The backlight unit may be implemented as a direct type backlight unit or an edge type backlight unit.

A pixel array including a plurality of liquid crystal cells (i.e., pixels) is formed on the display panel 28 according to the intersection structure of the data lines and the gate lines.

In the pixel array, pixels can be connected to source output channels of the source driver 26 through the data lines and connected to gate output channels of the gate driver 281 through the gate lines.

The timing controller 22 may be connected to the host system 10 through the eDP interface and connected to the source driver 26 through an EPI interface. The EPI interface is a signal transmission protocol for connecting the timing controller 22 to source driver ICs constituting the source driver 26 in a point-to-point manner to reduce the number of wires between the timing controller 22 and the source driver ICs and stabilizing signal transmission. However, the technical spirit of the present disclosure is not limited to the EPI interface. The timing controller 22 may be connected to the source driver 26 through another interface, for example, mini LVDS or V1.

The timing controller 22 can selectively activate a PSR operation and a normal refresh (hereinafter referred to as "NR") operation according to a PSR control signal transmitted from the host system 10. Specifically, the timing controller 22 can activate the PSR operation according to the PSR on signal and activate the NR operation according to the PSR off signal. In addition, the timing controller 22 can activate an LRR operation after activation of the PSR operation.

Further, the timing controller 22 controls all operations of the source driver 26 and the gate driver 281 which are associated with the PSR operation, the LRR operation and the NR operation. To this end, the timing controller 22 may include an eDP receiver 221 connected to the eDP transmitter 12 through the eDP interface, an LRR controller 222 for controlling the LRR operation, a GDC generator 223 for generating a gate timing control signal, an EPI transmitter 224 for generating a source timing control signal and transmitting the source timing control signal along with the input image data DATA to the source driver 26, and a memory 225 in which source output polarity inversion patterns are stored in advance.

The eDP receiver 221 can turn on the frame buffer RFB embedded therein when the PSR on signal is input from the eDP transmitter 12 and store the input image data DATA transmitted from the eDP transmitter 12 in the frame buffer RFB. The data stored in the frame buffer RFB can be written to the display panel 28 through the source driver 26 while the PSR on signal is maintained.

The memory 225 stores source output polarities POL with respect to the PSR operation and the NR operation as a first inversion pattern and stores source output polarities POL with respect to the LRR operation as a second inversion pattern in advance. Here, a source output polarity POL is a vertical polarity of a data voltage output from the source driver 26 (i.e., frame polarity).

The LRR controller 222 can reduce power consumption by blocking (i.e., floating) the source output channels of the source driver 26 at specific intervals (for example, 1 frame) when the LRR operation is activated. To this end, the LRR controller 222 can generate a source output masking signal ABDEN and apply the source output masking signal ABDEN to the source driver 26. In addition, the LRR controller 222 can further reduce power consumption by blocking (i.e., floating) the gate output channels of the gate driver 281 at specific intervals (for example, 1 frame) when the LRR operation is activated. The LRR controller 222 can generate a gate output masking signal (not shown) and apply the gate output masking signal to the gate driver 281.

The LRR controller 222 changes source output polarities POL in accordance with an LRR technique with reference to the memory 225 to minimize a period in which the same polarity is accumulated. To this end, the LRR controller 222 generates an LRR entry signal indicating the start of an LRR operation and an LRR exit signal indicating the end of the LRR operation, and then controls source output polarities POL with the first reverse pattern in PSR frames before the LRR operation, controls source output polarities POL with a third inversion pattern in LRR frames in which the LRR operation is performed, and controls source output polarities POL with a fourth inversion pattern in NR frames after the LRR operation ends. Particularly, the LRR controller 222 prevents the same polarity from being accumulated for three or more frames before and after an LRR entry time by generating the third inversion pattern with reference to the polarity of the last PSR frame included in the first inversion pattern. In addition, the LRR controller 222 prevents the same polarity from being accumulated for three or more frames before and after an LRR exit time by generating the fourth inversion pattern with reference to the polarity of the last LRR frame included in the second inversion pattern.

Here, LRR frames include a plurality of data frames in which image data DATA is written to the display panel 28 and a plurality of skip frames in which writing of image data to the display panel 28 is stopped. The output channels of the source driver 26 and the gate driver 281 are floated in response to a masking signal (ABDEN and the like) in the skip frames. The LRR controller 222 may control the output channels of the source driver 26 and the gate driver 281 such that the plurality of data frames and the plurality of skip frames are alternately arranged.

The GDC generator 223 generates gate timing control signals VST and GCLK for the PSR operation, NR operation and LRR operation. The voltage levels of the gate timing control signals VST and GCLK are boosted to be suited to a TFT operation of liquid crystal cells in the level shifter 24 and then applied to the gate driver 281.

The EPI transmitter 224 transmits the input image data DATA transmitted from the LRR controller 222, source output polarities POL, the source output masking signal ABDEN and the like to the source driver 26.

The source driver 26 may be composed of source driver ICs respectively including EPI receivers 261. The EPI receivers 261 of the source driver ICs can minimize the number of interface wires and stabilize signal transmission by being connected to the EPI transmitter 224 in a point-to-point manner. Each source driver IC converts input image data DATA into an analog data voltage and provides the analog data voltage to the data lines. Source output channels of the source driver ICs can be floated according to the source output masking signal ABDEN.

Meanwhile, the gate driver 281 may be embedded in the display panel 28. That is, the gate driver 281 may be directly formed in a non-display area (bezel area) of the display panel 28 through a TFT process of the pixel array. The gate driver 281 generates a scan signal synchronized with a data voltage and provides the scan signal to the gate lines. The gate output channels of the gate driver 281 can be floated according to the gate output masking signal.

FIG. 2 is a diagram showing a normal PSR technique which is not incorporated into an LRR technique.

Referring to FIG. 2, data transmission channels eDP Tx of the host system 10 are connected to the display module 20 in synchronization with the PSR off signal and input image data N+1 to N+7 is transmitted from the host system 10 to the display module 20 in first to third frames F #1 to F #3 and ninth to twelfth frames F #9 to F #12 in which a PSR operation is deactivated. Here, the timing controller 22 drives the source driver 26 and the gate driver 281 to write the input image data N+1 to N+7 to the display panel.

On the other hand, in fourth to eighth frames F #4 to F #8 in which the PSR operation is activated, the data transmission channels eDP Tx of the host system 10 are floated and disconnected from the display module 20 in synchronization with the PSR on signal and the input image data N+3 is stored in the frame buffer RFB of the display module 20. Here, the timing controller 22 drives the source driver 26 and the gate driver 281 to repeatedly write the input image data N+3 to the display panel 28. Accordingly, the same image data N+3 is repeatedly written to the display panel 28 during the PSR operation.

The timing controller 22 reverses source output polarities POL in units of one frame in all frames F #1 to F #12 irrespective of whether the PSR operation is activated. In addition, the timing controller 22 can activate the source output masking signal ABDEN and the gate output masking signal only in a vertical blank period between neighboring vertical active periods.

In this normal PSR technique, a problem of accumulation of the same polarity for three or more frames does not occur.

Figure 3:
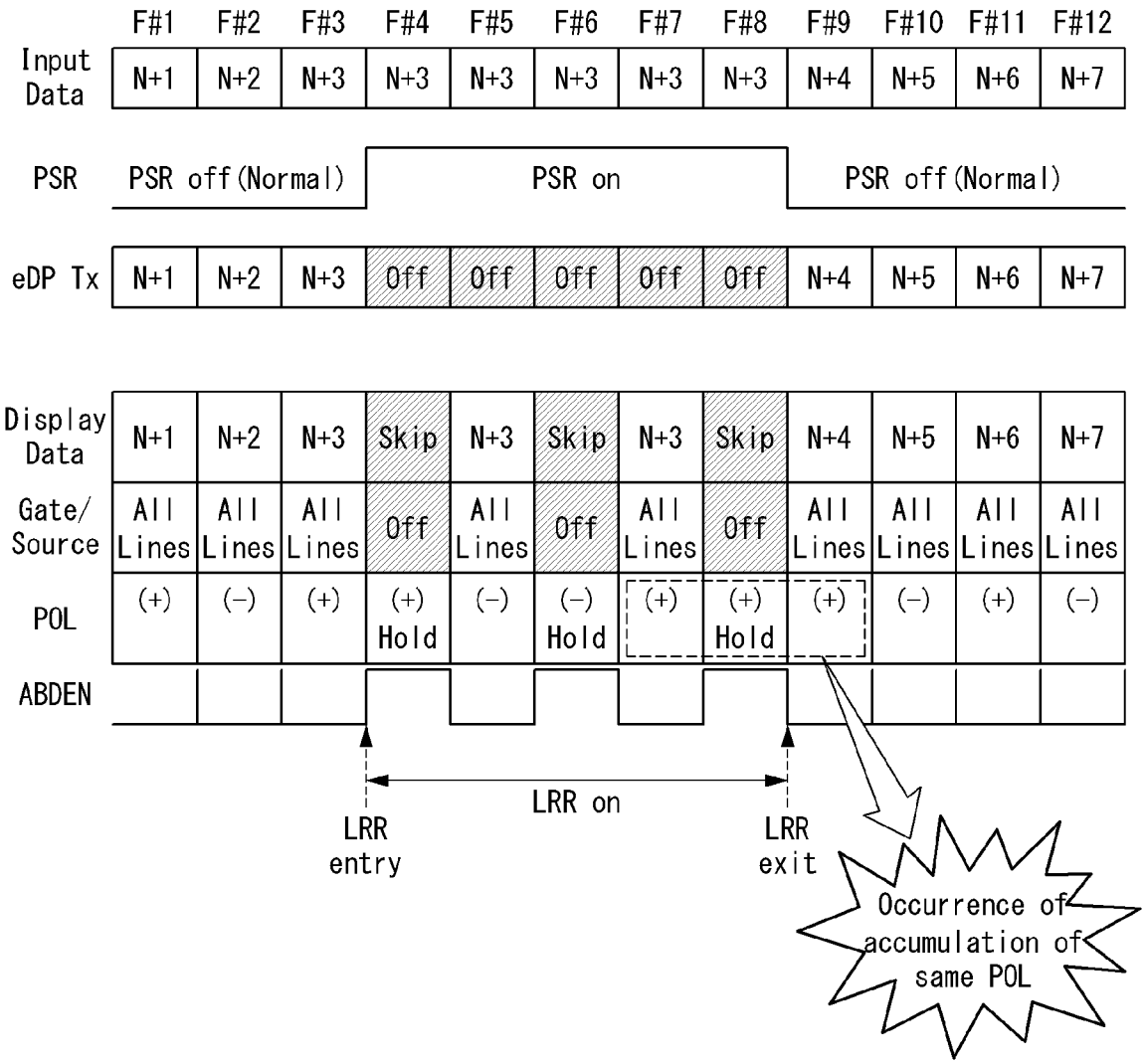
FIG. 3 is a diagram showing an example in which the same source output polarity is accumulated for three or more frames at an LRR exit time when an LRR technique is applied regardless of source output polarities in a PSR technique into which the LRR technique has been incorporated.

FIG. 3 is a diagram showing an example in which the same source output polarity is accumulated for three or more frames at an LRR exit time when an LRR technique is applied regardless of source output polarities in a PSR technique into which the LRR technique has been incorporated.

Referring to FIG. 3, the data transmission channels eDP Tx of the host system 10 are connected to the display module 20 in synchronization with the PSR off signal and input image data N+1 to N+7 is transmitted from the host system 10 to the display module 20 in first to third frames F #1 to F #3 and ninth to twelfth frames F #9 to F #12 in which a PSR operation is deactivated. Here, the timing controller 22 drives the source driver 26 and the gate driver 281 to write the input image data N+1 to N+7 to the display panel.

On the other hand, in fourth to eighth frames F #4 to F #8 in which the PSR operation is activated, the data transmission channels eDP Tx of the host system 10 are floated and disconnected from the display module 20 in synchronization with the PSR on signal and the input image data N+3 is stored in the frame buffer RFB of the display module 20. Here, the timing controller 22 may activate an LRR operation to alternately arrange skip frames and data frames in a PSR on period, float the output channels of the source driver 26 and the gate driver 281 in the skip frames and respectively connect the output channels of the source driver 26 and the output channels of the gate driver 281 to the data lines and the gate lines in the data frames. Images of immediately previous frames are maintained in the skip frames, and the source driver 26 and the gate driver 281 are driven and thus the input image data N+3 is repeatedly written to the display panel 28 in the data frames.

The timing controller 22 can activate the source output making signal ABDEN and the gate output masking signal in vertical blank periods and vertical active periods of the skip frames. The timing controller 22 stores source output polarities POL during an normal operation (PSR off) as the first inversion pattern in advance, stores source output polarities POL during an LRR operation as the second inversion pattern in advance, and then simply applies the first inversion pattern and the second inversion pattern. In this case, the same polarity (+) can be accumulated for a period of three frames before and after an LRR exit time shown in FIG. 3. Although not shown in FIG. 3, this problem also appears at an LRR entry time.

Figure 4:
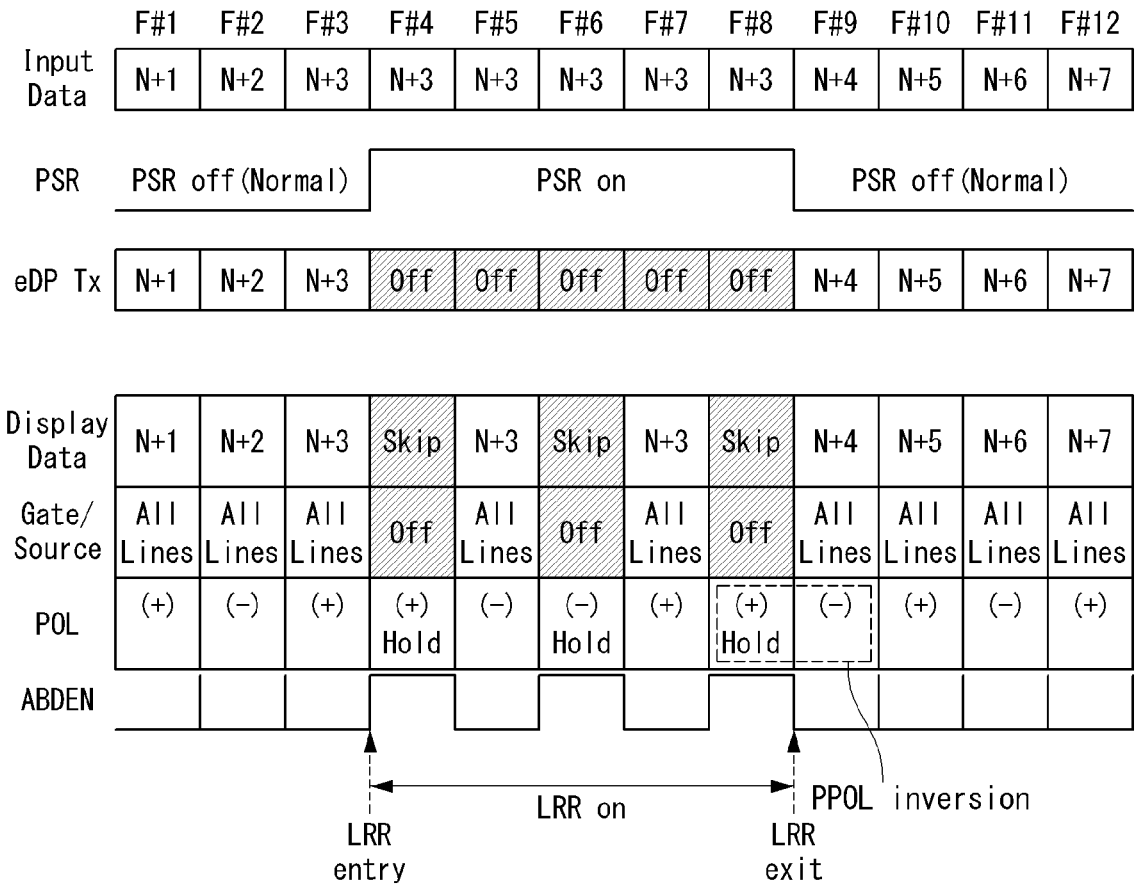
FIG. 4 is a diagram showing an example in which source output polarities are reversed such that the same source output polarity is not accumulated for three or more frames at an LRR entry or exit time.

FIG. 4 is a diagram showing an example in which source output polarities are reversed such that the same source output polarity is not accumulated for three or more frames at an LRR entry or exit time.

Referring to FIG. 4, to solve the problem illustrated in FIG. 3, the present disclosure generates the fourth inversion pattern (−+−+) with reference to the polarity (+) of the last LRR frame F #8 included in the second inversion pattern in the NR frames F #9 to F #12 after the LRR operation ends and controls the polarity (−) of the first NR frame F #9 included in the fourth inversion pattern to be reverse to the polarity (+) of the last LRR frame F #8 instead of simply applying the pre-stored first and second inversion patterns. Accordingly, the problem of accumulation of the same polarity (+) for a period of three frames before and after the LRR exit time is solved.

A solution of the same concept can be applied to an LRR entry time. The aforementioned concept will be described in detail with reference to FIGS. 10A to 11B.

Figure 5:
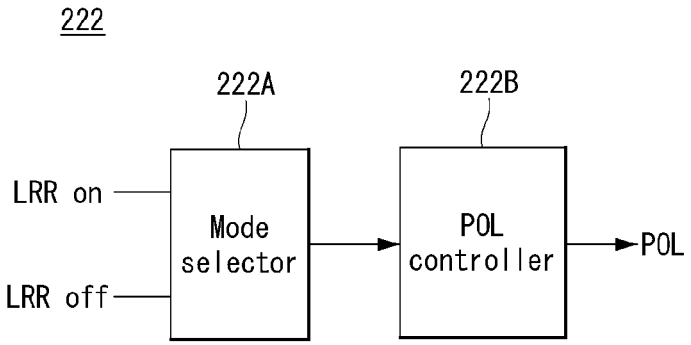
FIG. 5 is a diagram showing a configuration of an LRR controller of FIG. 1.
Figure 6:
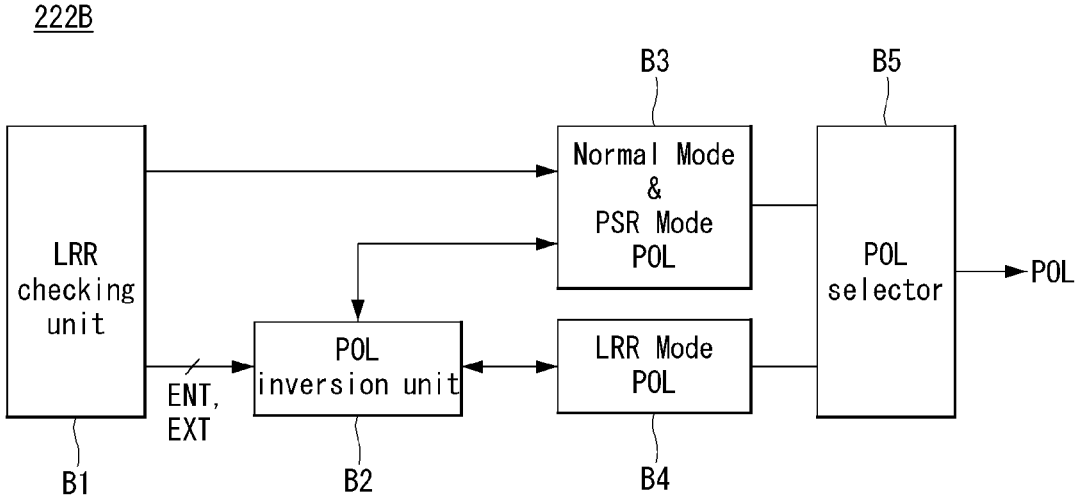
FIG. 6 is a diagram showing a configuration of a POL controller of FIG. 5.

FIG. 5 is a diagram showing a configuration of the LRR controller of FIG. 1 and FIG. 6 is a diagram showing a configuration of a POL controller of FIG. 5.

Referring to FIG. 5, the LRR controller 222 includes a mode selector 222A and a POL controller 222B.

The mode selector 222A checks whether a PSR operation is activated and selects a PSR mode. In addition, the mode selector 222A checks whether an LRR operation is activated in the PSR mode and enters an LRR mode. The mode selector 222A selects an NR mode after the LRR mode ends.

The POL controller 222B checks LRR setting conditions and reverses source output polarities POL on the basis of an LRR entry time and an LRR exit time.

Specifically, referring to FIG. 6, the POL controller 222B may include an LRR checking unit B1, a POL inversion unit B2, inversion patterns B3 and B4 for respective modes stored in a memory, and a POL selector B5.

The LRR checking unit B1 checks preset LRR setting conditions and generates an LRR entry signal ENT indicating the start of an LRR operation and an LRR exit signal EXT indicating the end of the LRR operation.

The inversion patterns B3 and B4 for respective modes include the first inversion pattern associated with a PSR operation and an NR operation and the second inversion pattern associated with an LRR operation respectively.

The POL inversion unit B2 reverses source output polarities POL according to the first inversion pattern in PSR frames before the LRR entry signal ENT is input, reverses source output polarities POL according to the third inversion pattern in LRR frames in response to input of the LRR entry signal ENT, and reverses source output polarities POL according to the fourth inversion pattern in NR frames after the LRR operation ends in response to input of the LRR exit signal EXT.

The POL inversion unit B2 generates the third inversion pattern with reference to the polarity of the last PSR frame included in the first inversion pattern and generates the fourth inversion pattern with reference to the polarity of the last LRR frame included in the second inversion pattern. Specifically, the POL inversion unit B2 controls the polarity of the first LRR frame included in the third inversion pattern to be reverse to the polarity of the last PSR frame and controls the polarity of the first NR frame included in the fourth inversion pattern to be reverse to the polarity of the last LRR frame.

The POL selector B5 is connected to the inversion patterns B3 and B4 for respective modes and the POL inversion unit B2 and selects and outputs optimal POL for minimizing a period in which the same polarity is accumulated in consecutive frames.

FIG. 7 is a diagram showing the first and second inversion patterns for source output polarities which are preset with respect to the PSR operation & the normal refresh operation, and an LRR operation respectively.

Referring to FIG. 7, the first inversion pattern for source output polarities preset in the memory may be a repeated pattern of "+−+−" and the second inversion pattern for source output polarities preset in the memory may be a repeated pattern of "++−−".

FIG. 8 is a diagram showing various examples of an LRR entry time and source output polarity changes corresponding thereto as a comparative example of the present disclosure and FIG. 9 is a diagram showing various examples of an LRR exit time and source output polarity changes corresponding thereto as a comparative example of the present disclosure;

Referring to FIG. 8, an LRR entry time may be a fourteenth frame F #14 as in case 1, a thirteenth frame F #13 as in case 2, a twelfth frame F #12 as in case 3 and a eleventh frame F #11 as in case 4. The first LRR frame is a skip frame S in cases 1 and 3 and the first LRR frame is a data frame D in cases 2 and 4.

Here, when the first inversion pattern is simply applied to PSR frames before an LRR entry time and the second inversion pattern is simply applied to LRR frames after the LRR entry time, a problem of accumulation of the same polarity (−) for a period of three frames may occur as in case 4.

Referring to FIG. 9, an LRR exit time may be a seventh frame F #7 as in case 1, an eighth frame F #8 as in case 2, a ninth frame F #9 as in case 3 and a tenth frame F #10 as in case 4. The last LRR frame is a skip frame S in cases 1 and 3 and the last LRR frame is a data frame D in cases 2 and 4.

Here, when the first inversion pattern is simply applied to NR frames after an LRR exit time and the second inversion pattern is simply applied to LRR frames before the LRR exit time, a problem of accumulation of the same polarity (+) for a period of three frames may occur as in case 1.

In FIGS. 7 to 9, "D" represents a data frame, "S" represents a skip frame, "P" denotes a positive (+) pattern, "P'" denotes a negative (−) pattern, and "H" denotes holding of the polarity of an immediately previous frame.

Figure 10A:
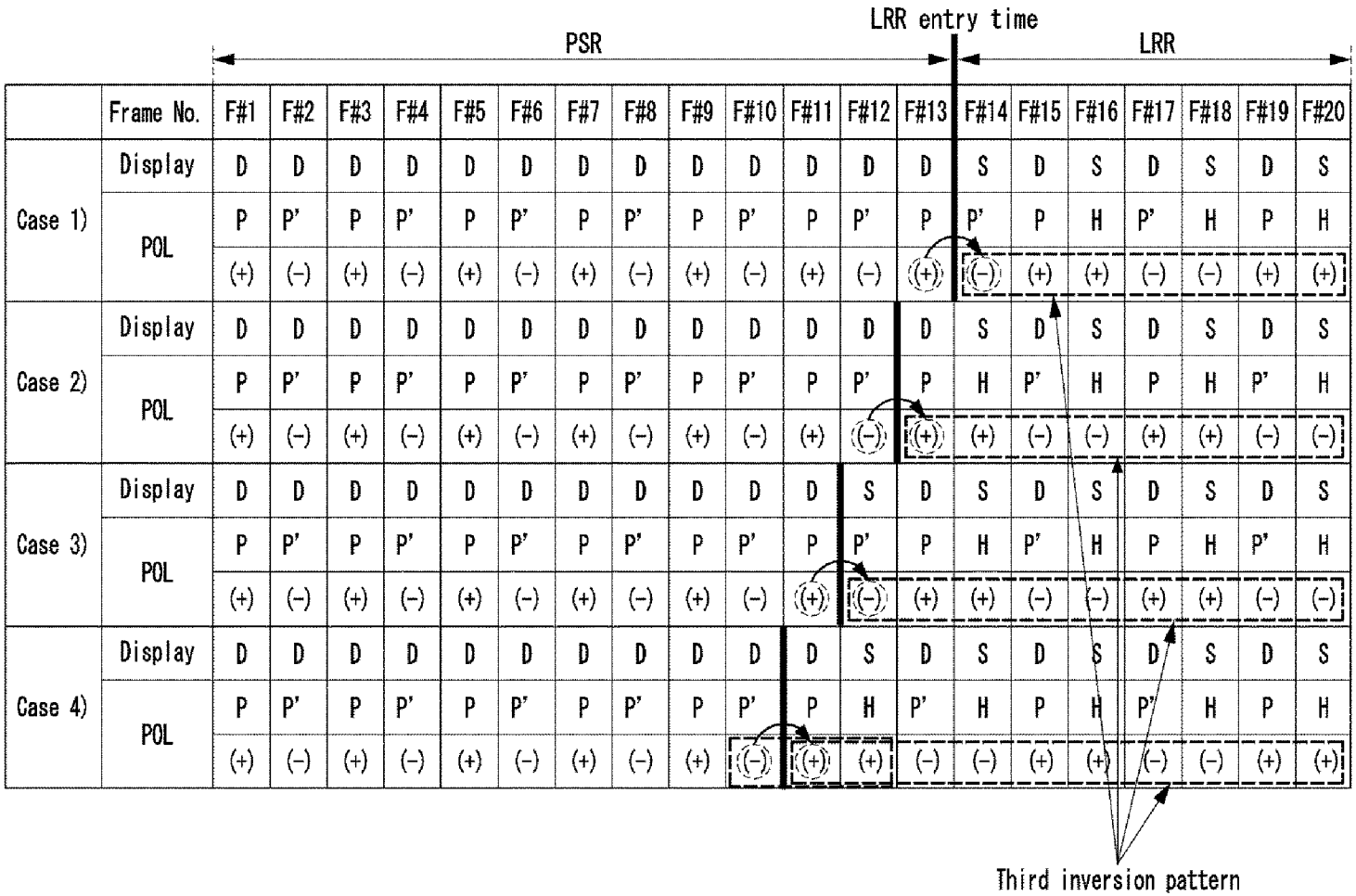
FIGS. 10A and 10B are diagrams showing examples of controlling source output polarities with a third inversion pattern in LRR frames in which an LRR operation is performed as an aspect of the present disclosure.
Figure 10B:
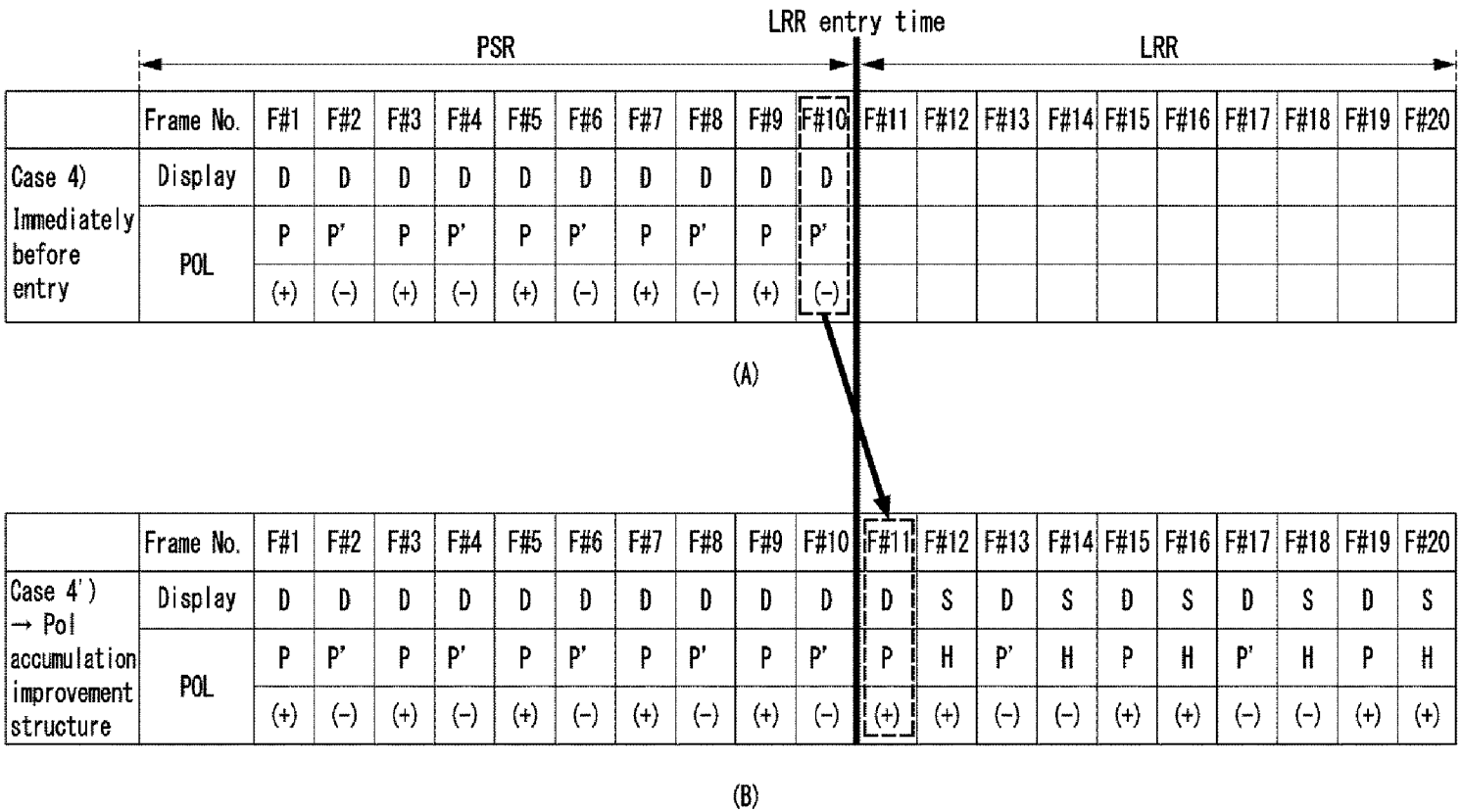

FIGS. 10A and 10B are diagrams showing examples of controlling source output polarities with the third inversion pattern in LRR frames in which an LRR operation is performed as an aspect of the present disclosure.

Referring to FIGS. 10A and 10B, the LRR controller 222 of the present disclosure may respectively control the polarities of the first LRR frames F #14, F #13, F #12 and F #11 to be reverse to the polarities of the last PSR frames F #13, F #12, F #11 and F #10 irrespective of whether the first LRR frames F #14, F #13, F #12 and F #11 are data frames D or skip frames S in cases 1 to 4.

When the first LRR frames F #14, F #13, F #12 and F #11 are data frames D, the LRR controller 222 may reverse the polarities of LRR frames in odd-numbered data frames D on the basis of immediately previous data frames D and hold the polarities of LRR frames in even-numbered skip frames S on the basis of immediately previous data frames D.

On the other hand, when the first LRR frames F #14, F #13, F #12 and F #11 are skip frames S, the LRR controller 222 may reverse the polarities of LRR frames in even-numbered data frames D on the basis of the first LRR frames or immediately previous data frames D and hold the polarities of LRR frames in odd-numbered skip frames S other than the first LRR frames on the basis of immediately previous data frames D.

As described above, according to the polarity control method of the present disclosure, the problem of accumulation of the same polarity (−) for a period of three frames as in case 4 of FIG. 8 can be easily solved as clearly illustrated in FIG. 10B.

Figure 11A:
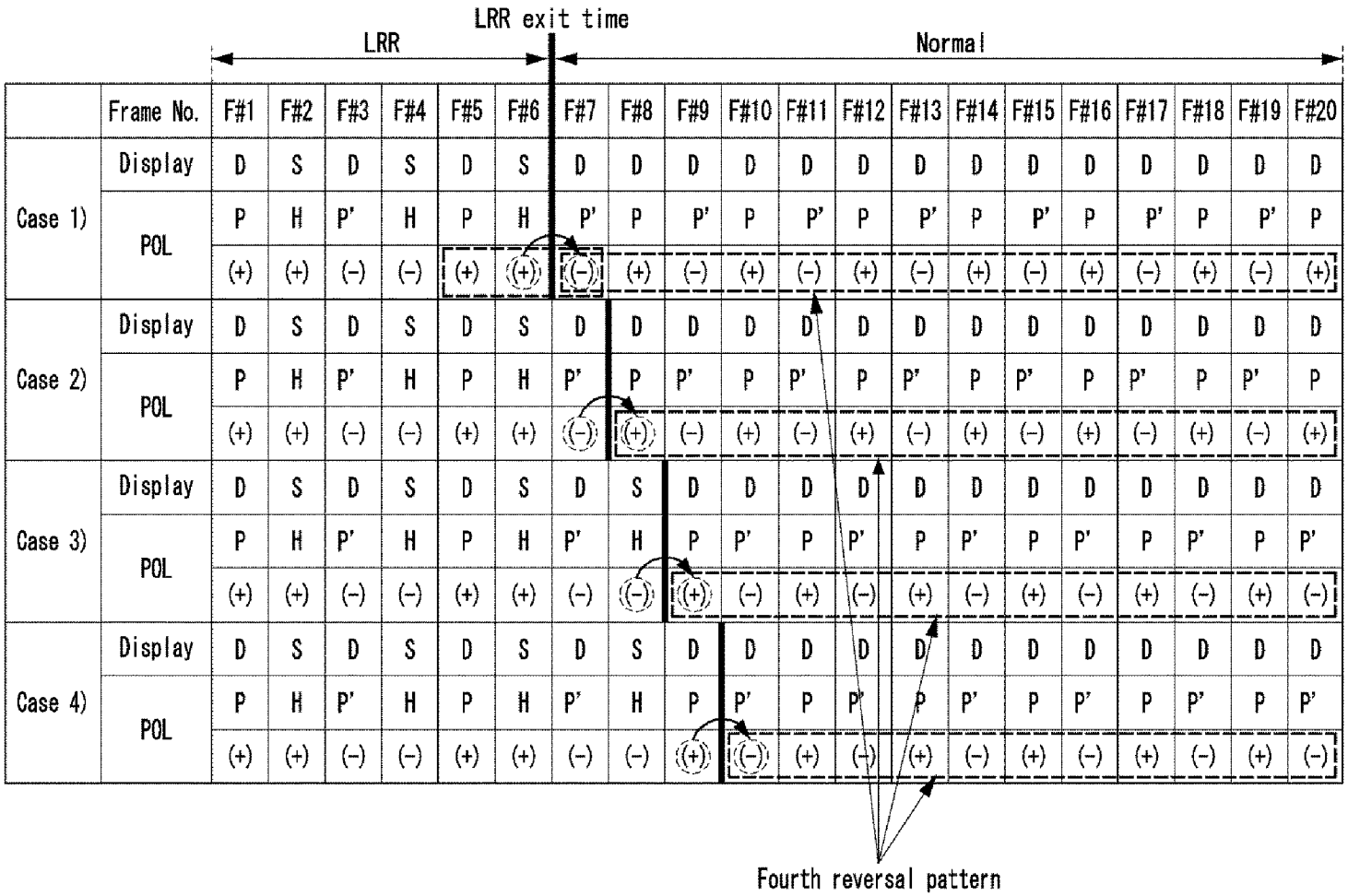
FIGS. 11A and 11B are diagrams showing examples of controlling source output polarities with a fourth inversion pattern in normal refresh frames after an LRR operation ends as an aspect of the present disclosure.
Figure 11B:
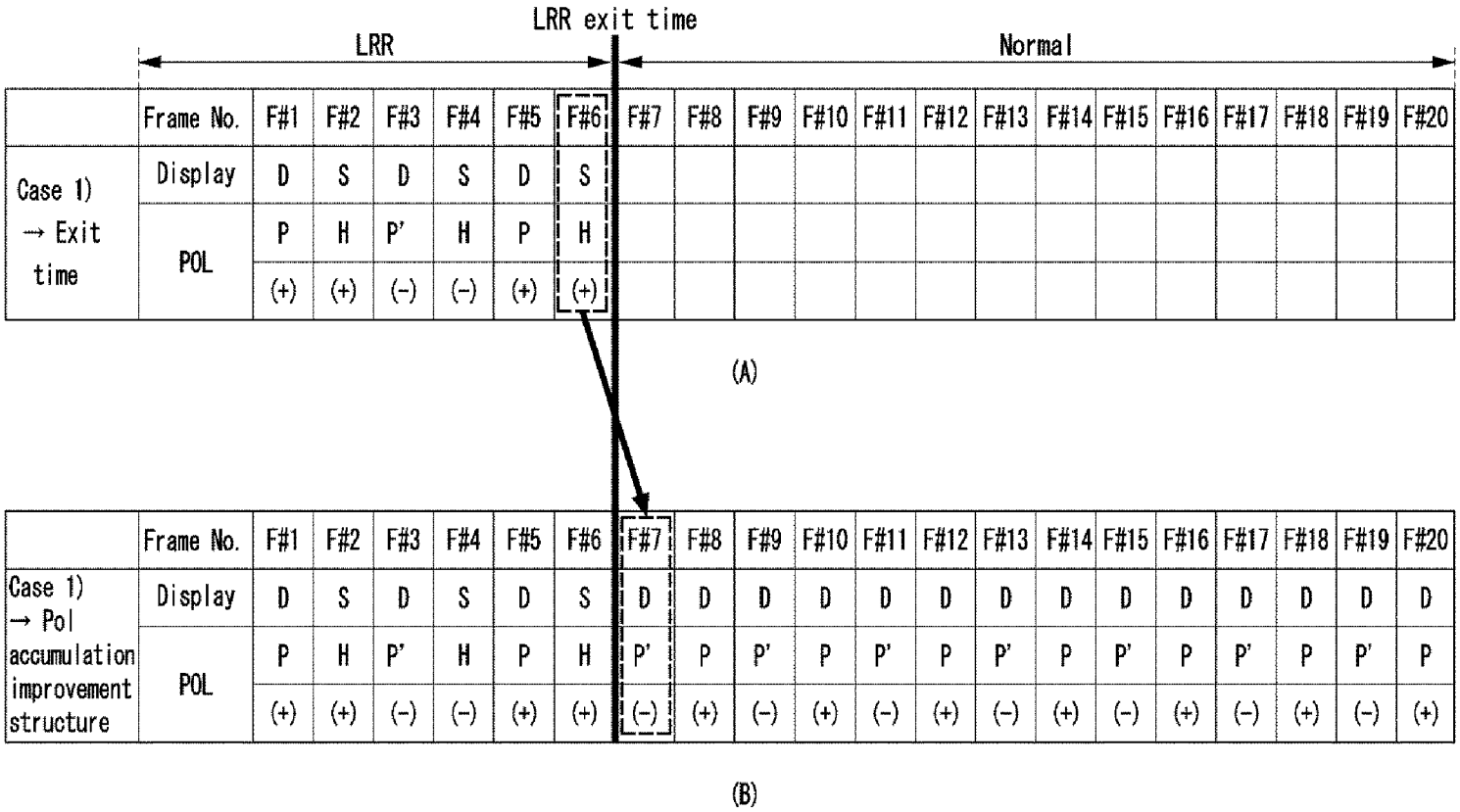

FIGS. 11A and 11B are diagrams showing examples of controlling source output polarities with the fourth inversion pattern in normal refresh frames after an LRR operation ends as an aspect of the present disclosure.

Referring to FIGS. 11A and 11B, the LRR controller 222 of the present disclosure may respectively control the polarities of first NR frames F #7, F #8, F #9 and F #10 to be reverse to the polarities of last LRR frames F #6, F #7, F #8 and F #9 irrespective of whether the last LRR frames F #6, F #7, F #8 and F #9 are data frames D or skip frames S in cases 1 to 4.

In addition, the LRR controller 222 may reverse the polarities of NR frames in the second and following NR frames on the basis of immediately previous data frames.

According to this polarity control method of the present disclosure, the problem of accumulation of the same polarity (+) for a period of three frames as in case 1 of FIG. 9 can be easily solved as clearly illustrated in FIG. 11B.

Figure 12:
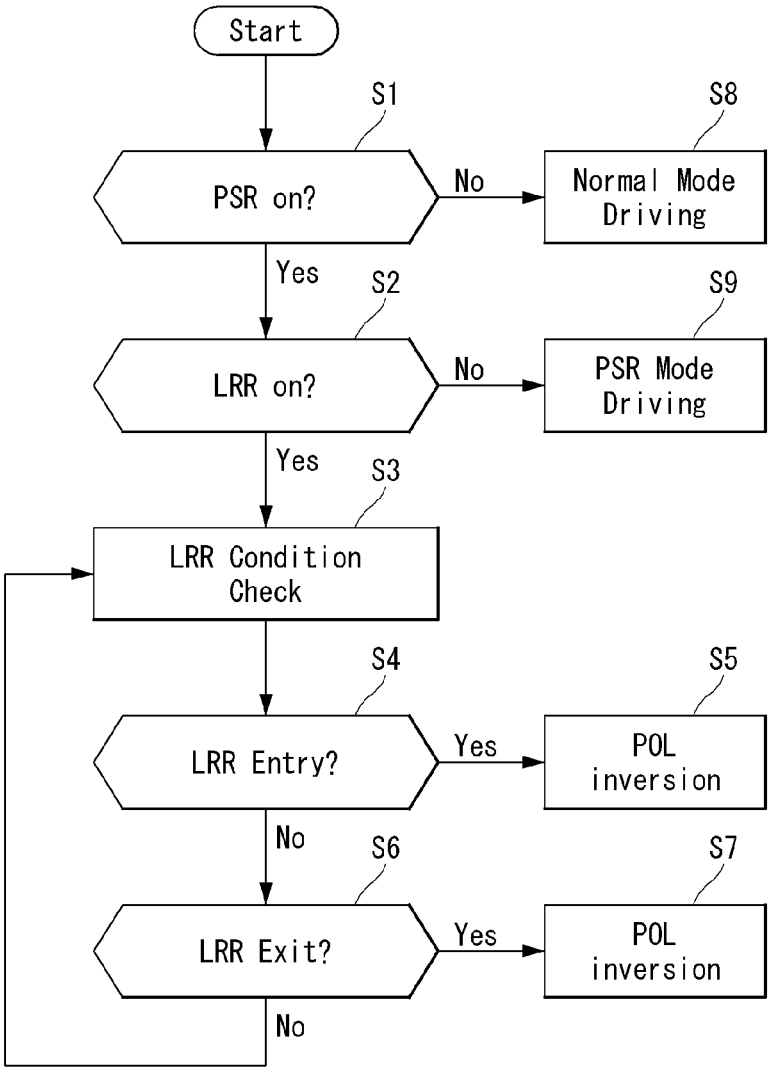
FIG. 12 is a diagram showing a method of driving the liquid crystal display device according to an aspect of the present disclosure.

FIG. 12 is a diagram showing a method of driving the liquid crystal display device according to an aspect of the present disclosure.

Referring to FIG. 12, the method of driving the liquid crystal display device according to an aspect of the present disclosure enters the LRR mode if an LRR operation is activated in a state in which a PSR operation has been activated and enters the PSR mode (refer to FIG. 2) if an LRR operation is not activated in a state in which a PSR operation has been activated. In addition, the method enters the NR mode if the PSR operation (or LRR operation) ends and thus is deactivated (S1, S2, S8 and S9).

Subsequently, the driving method of the present disclosure checks LRR setting conditions after entering the LRR mode, generates an LRR entry signal indicating the start of an LRR operation and an LRR exit signal indicating the end of the LRR operation, controls source output polarities POL with the first inversion pattern in PSR frames before the LRR operation is performed, controls the source output polarities POL with the third inversion pattern in LRR frames in which the LRR operation is performed, and controls the source output polarities POL with the fourth inversion pattern in NR frames after the LRR operation ends. Particularly, the LRR controller 222 prevents the same polarity from being accumulated for three or more frames before and after an LRR entry time by generating the third inversion pattern with reference to the polarity of the last PSR frame included in the first inversion pattern (S4 and S5). In addition, the LRR controller 222 prevents the same polarity from being accumulated for three or more frames before and after an LRR exit time by generating the fourth inversion pattern with reference to the polarity of the last LRR frame included in the second inversion pattern (S6 and S7).

As described above, the present disclosure can minimize a period in which the same polarity is accumulated by reversing source output polarities with reference to the polarity of a previous frame at an LRR exit time, preventing abnormal display and improving display quality.

A liquid crystal display device and driving method according to various aspects of the disclosure may be described as follows.

A liquid crystal display device comprises a display panel; a source driver configured to provide source outputs to the display panel; a memory configured to store polarities of source outputs with respect to a panel self-refresh operation and a normal refresh operation that is not the panel self-refresh operation as a first inversion pattern and to store polarities of source outputs with respect to a low refresh rate operation as a second inversion pattern; and an LRR controller configured to control the polarities of the source outputs with the first inversion pattern in panel self-refresh frames before the low refresh rate operation is performed, to control the polarities of the source outputs with a third inversion pattern referring to the first inversion pattern in low refresh rate frames in which the low refresh rate operation is performed, and to control the polarities of the source outputs with a fourth inversion pattern referring to the second inversion pattern in normal refresh frames after the low refresh rate operation ends.

The LRR controller generates the third inversion pattern with reference to the polarity of a last panel self-refresh frame included in the first inversion pattern and generates the fourth inversion pattern with reference to the polarity of a last low refresh rate frame included in the second inversion pattern.

The LRR controller controls the polarity of a first low refresh rate frame included in the third inversion pattern to be reverse to the polarity of the last panel self-refresh frame and controls the polarity of a first normal refresh frame included in the fourth inversion pattern to be reverse to the polarity of the last low refresh rate frame.

The low refresh rate frames include a plurality of data frames in which image data is written to the display panel and a plurality of skip frames in which writing of image data to the display panel is stopped, and the plurality of data frames and the plurality of skip frames are alternately arranged one by one, The LRR controller controls the polarity of the first low refresh rate frame to be reverse to the polarity of the last panel self-refresh frame irrespective of whether the first low refresh rate frame is a data frame or a skip frame.

When the first low refresh rate frame is a data frame, the LRR controller reverses the polarities of low refresh rate frames in odd-numbered data frames on the basis of immediately previous data frames and holds the polarities of low refresh rate frames in even-numbered skip frames on the basis of immediately previous data frames.

When the first low refresh rate frame is a skip frame, the LRR controller reverses the polarities of low refresh rate frames in even-numbered data frames on the basis of the first low refresh rate frame or immediately previous data frames and holds the polarities of low refresh rate frames in odd-numbered skip frames other than the first low refresh rate frame on the basis of immediately previous data frames.

The normal refresh frames include a plurality of data frames in which image data is written to the display panel, and the LRR controller controls the polarity of the first normal refresh frame to be reverse to the polarity of the last low refresh rate frame irrespective of whether the last low refresh rate frame is a data frame or a skip frame and reverses the polarities of normal refresh frames in the second and following normal refresh frames on the basis of immediately previous frames.

The memory and the LRR controller are embedded in a timing controller, wherein the timing controller selectively activates the panel self-refresh operation and the normal refresh operation according to a panel self-refresh control signal transmitted from a host system and activates the low refresh rate operation after the panel self-refresh operation is activated.

The LRR controller comprises: an LRR checking unit for checking preset LRR setting conditions and generating an LRR entry signal indicating the start of the low refresh rate operation and an LRR exit signal indicating the end of the low refresh rate operation; and a POL inversion unit for reversing the polarities of the source outputs according to the first inversion pattern in panel self-refresh frames before the LRR entry signal is input, reversing the polarities of the source outputs according to the third inversion pattern in the low refresh rate frames in response to input of the LRR entry signal, and reversing the polarities of the source outputs according to the fourth inversion pattern in normal refresh frames after the low refresh rate operation ends in response to input of the LRR exit signal.

Data transmission channels of the host system are floated when the panel self-refresh operation is activated and source output channels of the source driver are floated at specific intervals when the low refresh rate operation is activated.

The liquid crystal display device further comprises a gate driver for providing gate outputs synchronized with the source outputs to the display panel, wherein gate output channels of the gate driver are floated at the specific intervals when the low refresh rate operation is activated.

A method of driving a liquid crystal display device having a display panel and a source driver for providing source outputs to the display panel, comprises: referring to a memory storing polarities of source outputs with respect to a panel self-refresh operation and a normal refresh operation that is not the panel self-refresh operation as a first inversion pattern and storing polarities of source outputs with respect to a low refresh rate operation as a second inversion pattern; and controlling the polarities of the source outputs with the first inversion pattern in panel self-refresh frames before the low refresh rate operation is performed, controlling the polarities of the source outputs with a third inversion pattern referring to the first inversion pattern in low refresh rate frames in which the low refresh rate operation is performed, and controlling the polarities of the source outputs with a fourth inversion pattern referring to the second inversion pattern in normal refresh frames after the low refresh rate operation ends.

The third inversion pattern is generated with reference to the polarity of a last panel self-refresh frame included in the first inversion pattern and the fourth inversion pattern is generated with reference to the polarity of a last low refresh rate frame included in the second inversion pattern.

The polarity of a first low refresh rate frame included in the third inversion pattern is controlled to be reverse to the polarity of the last panel self-refresh frame and the polarity of a first normal refresh frame included in the fourth inversion pattern is controlled to be reverse to the polarity of the last low refresh rate frame.

The low refresh rate frames include a plurality of data frames in which image data is written to the display panel and a plurality of skip frames in which writing of image data to the display panel is stopped, and the plurality of data frames and the plurality of skip frames are alternately arranged one by one, wherein the polarity of the first low refresh rate frame is controlled to be reverse to the polarity of the last panel self-refresh frame irrespective of whether the first low refresh rate frame is a data frame or a skip frame.

It will be understood by those skilled in the art that the disclosure can be changed and modified in various manners without departing from the technical spirit of the disclosure through the above description. Therefore, the technical scope of the specification should be defined by the appended claims rather than the detailed description of the disclosure.

What is claimed is:

1. A liquid crystal display device comprising:

a display panel;

a source driver configured to provide source outputs to the display panel;

a memory configured to store polarities of the source outputs with respect to a panel self-refresh operation and a normal refresh operation that is not the panel self-refresh operation as a first inversion pattern and to store the polarities of source outputs with respect to a low refresh rate operation as a second inversion pattern; and a low refresh rate (LRR) controller configured to control the polarities of the source outputs with the first inversion pattern in panel self-refresh frames before the low refresh rate operation is performed, to control the polarities of the source outputs with a third inversion pattern referring to the first inversion pattern in low refresh rate frames in which the low refresh rate operation is performed, and to control the polarities of the source outputs with a fourth inversion pattern referring to the second inversion pattern in normal refresh frames after the low refresh rate operation ends.

2. The liquid crystal display device of claim 1, wherein the LRR controller generates the third inversion pattern with reference to the polarity of a last panel self-refresh frame included in the first inversion pattern and generates the fourth inversion pattern with reference to the polarity of a last low refresh rate frame included in the second inversion pattern.

3. The liquid crystal display device of claim 2, wherein the LRR controller controls the polarity of a first low refresh rate frame included in the third inversion pattern to be reverse to the polarity of the last panel self-refresh frame and controls the polarity of a first normal refresh frame included in the fourth inversion pattern to be reverse to the polarity of the last low refresh rate frame.

4. The liquid crystal display device of claim 3, wherein the low refresh rate frames include a plurality of data frames in which image data is written to the display panel and a plurality of skip frames in which writing of image data to the display panel is stopped, and the plurality of data frames and the plurality of skip frames are alternately arranged one by one.

5. The liquid crystal display device of claim 4, wherein the LRR controller controls the polarity of the first low refresh rate frame to be reverse to the polarity of the last panel self-refresh frame irrespective of whether the first low refresh rate frame is a data frame or skip frame.

6. The liquid crystal display device of claim 4, wherein, when the first low refresh rate frame is a data frame, the LRR controller reverses the polarities of the low refresh rate frames in odd-numbered data frames based on an immediately previous data frame and holds the polarities of the low refresh rate frames in even-numbered skip frames based on the immediately previous data frame.

7. The liquid crystal display device of claim 4, wherein, when the first low refresh rate frame is a skip frame, the LRR controller reverses the polarities of the low refresh rate frames in even-numbered data frames based on the first low refresh rate frame or an immediately previous data frame and holds the polarities of the low refresh rate frames in odd-numbered skip frames other than the first low refresh rate frame based on the immediately previous data frame.

8. The liquid crystal display device of claim 3, wherein the normal refresh frames include a plurality of data frames in which image data is written to the display panel, and the LRR controller controls the polarity of the first normal refresh frame to be reverse to the polarity of the last low refresh rate frame irrespective of whether the last low refresh rate frame is a data frame or a skip frame and reverses the polarities of normal refresh frames in the second and following normal refresh frames based on an immediately previous frame.

9. The liquid crystal display device of claim 1, wherein the memory and the LRR controller are embedded in a timing controller.

10. The liquid crystal display device of claim 9, wherein the timing controller selectively activates the panel self-refresh operation and the normal refresh operation according to a panel self-refresh control signal transmitted from a host system and activates the low refresh rate operation after the panel self-refresh operation is activated.

11. The liquid crystal display device of claim 9, wherein the LRR controller comprises:

an LRR checking circuit that checks preset LRR setting conditions and generates an LRR entry signal indicating the start of the low refresh rate operation and an LRR exit signal indicating the end of the low refresh rate operation; and a POL inversion circuit that reverses the polarities of the source outputs according to the first inversion pattern in panel self-refresh frames before the LRR entry signal is input, reverses the polarities of the source outputs according to the third inversion pattern in the low refresh rate frames in response to input of the LRR entry signal, and reverses the polarities of the source outputs according to the fourth inversion pattern in normal refresh frames after the low refresh rate operation ends in response to input of the LRR exit signal.

12. The liquid crystal display device of claim 10, wherein data transmission channels of the host system are floated when the panel self-refresh operation is activated and source output channels of the source driver are floated at specific intervals when the low refresh rate operation is activated.

13. The liquid crystal display device of claim 12, further comprising a gate driver providing gate outputs synchronized with the source outputs to the display panel, wherein gate output channels of the gate driver are floated at the specific intervals when the low refresh rate operation is activated.

14. A method of driving a liquid crystal display device having a display panel and a source driver providing source outputs to the display panel, the method comprising:

referring to a memory storing polarities of the source outputs with respect to a panel self-refresh operation and a normal refresh operation that is not the panel self-refresh operation as a first inversion pattern and storing the polarities of the source outputs with respect to a low refresh rate operation as a second inversion pattern; and controlling the polarities of the source outputs with the first inversion pattern in panel self-refresh frames before the low refresh rate operation is performed, controlling the polarities of the source outputs with a third inversion pattern referring to the first inversion pattern in low refresh rate frames in which the low refresh rate operation is performed, and controlling the polarities of the source outputs with a fourth inversion pattern referring to the second inversion pattern in normal refresh frames after the low refresh rate operation ends.

15. The method of claim 14, wherein the third inversion pattern is generated with reference to the polarity of a last panel self-refresh frame included in the first inversion pattern and the fourth inversion pattern is generated with reference to the polarity of a last low refresh rate frame included in the second inversion pattern.

16. The method of claim 15, wherein the polarity of a first low refresh rate frame included in the third inversion pattern is controlled to be reverse to the polarity of the last panel self-refresh frame and the polarity of a first normal refresh frame included in the fourth inversion pattern is controlled to be reverse to the polarity of the last low refresh rate frame.

17. The method of claim 16, wherein the low refresh rate frames include a plurality of data frames in which image data is written to the display panel and a plurality of skip frames in which writing of image data to the display panel is stopped, and the plurality of data frames and the plurality of skip frames are alternately arranged, and wherein the polarity of the first low refresh rate frame is controlled to be reverse to the polarity of the last panel self-refresh frame irrespective of whether the first low refresh rate frame is a data frame or a skip frame.

18. The method of claim 17, wherein, when the first low refresh rate frame is a data frame, the polarities of low refresh rate frames are reversed in odd-numbered data frames on the basis of immediately previous data frames and the polarities of low refresh rate frames are held in even-numbered skip frames based on an immediately previous data frame.

19. The method of claim 18, wherein, when the first low refresh rate frame is a skip frame, the polarities of low refresh rate frames are reversed in even-numbered data frames on the basis of the first low refresh rate frame or an immediately previous data frame and the polarities of low refresh rate frames are held in odd-numbered skip frames other than the first low refresh rate frame based on the immediately previous data frame.

20. The method of claim 17, wherein the normal refresh frames include a plurality of data frames in which image data is written to the display panel, and the polarity of the first normal refresh frame is controlled to be reverse to the polarity of the last low refresh rate frame irrespective of whether the last low refresh rate frame is a data frame or a skip frame and the polarities of normal refresh frames are reversed in the second and following normal refresh frames based on an immediately previous frame.

* * * * *